US009289055B2

(12) United States Patent
Slocum et al.

(10) Patent No.: US 9,289,055 B2
(45) Date of Patent: Mar. 22, 2016

(54) FORCE SENSITIVE TOOTHBRUSH

(71) Applicant: Jonathan T. Slocum, Bow, NH (US)

(72) Inventors: Alexander H. Slocum, Bow, NH (US); Jonathan T. Slocum, Bow, NH (US)

(73) Assignee: Jonathan T. Slocum, Bow, NH (US)

( * ) Notice: Subject to any disclaimer, the term of this patent is extended or adjusted under 35 U.S.C. 154(b) by 397 days.

(21) Appl. No.: 13/836,581

(22) Filed: Mar. 15, 2013

(65) Prior Publication Data

US 2014/0020198 A1 Jan. 23, 2014

Related U.S. Application Data

(60) Provisional application No. 61/674,813, filed on Jul. 23, 2012.

(51) Int. Cl.
*A46B 9/04* (2006.01)
*A46B 15/00* (2006.01)

(52) U.S. Cl.
CPC ..... *A46B 15/0038* (2013.01); *A46B 9/04* (2013.01); *A46B 15/004* (2013.01); *A46B 15/0012* (2013.01); *A46B 2200/1053* (2013.01); *A46B 2200/1066* (2013.01)

(58) Field of Classification Search
CPC ..... A46B 5/0062; A46B 5/0066; A46B 9/04
See application file for complete search history.

(56) References Cited

U.S. PATENT DOCUMENTS 4,340,069 A 7/1982 Yeaple
4,476,604 A 10/1984 White
4,520,526 A 6/1985 Peters
4,680,825 A 7/1987 White et al.
5,105,499 A 4/1992 Dirksing
5,146,645 A 9/1992 Dirksing (Continued)

FOREIGN PATENT DOCUMENTS

DE 4211811 10/1993
WO WO-2014018323 1/2014

OTHER PUBLICATIONS

Ganss, Carolina et al., "Effects of toothbrushing force on the mineral content and demineralized organic matrix of eroded dentine", European Journal of Oral Sciences, Jan. 2009, pp. 255-260.

(Continued)

*Primary Examiner* — Randall Chin
(74) *Attorney, Agent, or Firm* — Strategic Patents, P.C.

(57) ABSTRACT

A force-sensitive toothbrush incorporates a bistable mechanism into the toothbrush handle. The mechanism can alert a user to excessive brushing force by changing shape in response to brushing forces exceeding a predetermined threshold. The mechanism can also automatically return to its original state when the brushing forces are lowered back down below the predetermined level. In one aspect, the mechanism may include a force-sensitive region having a principal beam and a secondary notched hinge buckling support beam located within the handle between the bristles and the gripping portion of the toothbrush. In another aspect, the force-sensitive region includes a principal beam and a secondary un-notched buckling support beam. In another aspect, the force-sensitive region includes a principal beam and a secondary support beam with a toothed clutch. These mechanisms can advantageously be molded into an integral toothbrush body using an injection molding operation.

16 Claims, 7 Drawing Sheets

(56) References Cited

U.S. PATENT DOCUMENTS

| | | | | |
|---|---|---|---|---|
| 5,282,291 | A | 2/1994 | Spieler et al. | |
| 5,315,732 | A | 5/1994 | Huefner et al. | |
| 5,331,707 | A | 7/1994 | Irizarry | |
| 5,355,544 | A | 10/1994 | Dirksing | |
| 5,876,207 | A | 3/1999 | Sundius et al. | |
| 6,003,189 | A | 12/1999 | Falleiros | |
| 6,108,849 | A | 8/2000 | Weihrauch | |
| 6,389,636 | B1 | 5/2002 | Savill | |
| 6,412,137 | B1 | 7/2002 | Heidari | |
| 6,425,295 | B1 | 7/2002 | Meginniss | |
| 7,213,995 | B2 | 5/2007 | Bravo-Loubriel | |
| 7,383,603 | B2 | 6/2008 | Edwards | |
| 8,544,131 | B2 * | 10/2013 | Braun | A46B 15/0002 15/105 |
| 8,769,758 | B2 * | 7/2014 | Jungnickel | A46B 15/0012 15/105 |
| 2005/0022322 | A1 | 2/2005 | Jimenez et al. | |
| 2006/0104456 | A1 | 5/2006 | Filo et al. | |
| 2011/0016651 | A1 | 1/2011 | Piserchio | |
| 2011/0179594 | A1 | 7/2011 | Zini | |
| 2012/0036662 | A1 | 2/2012 | Kling et al. | |

OTHER PUBLICATIONS

Van Der Weijden, G.A. et al., "High and low brushing force in relation to efficacy and gingival abrasion", Journal of Clinical Periodontology, Oct. 9, 2003 , pp. 620-624.

"Too Much Pressure or Time Brushing Your Teeth Can Hurt", WebMD Health News. http://www.webmd.com/oral-health/news/20030620/go-easy-toothbrush Jun. 20, 2003 , 2 Pages.

"Oral-B Triumph", http://www.oralb.com/en-SG/products/pc9500/, 2013 , 2 pages.

Wiegand, Annette et al., "Brushing force of manual and sonic toothbrushes affects dental hard tissue abrasion", Clin Oral Invest (2013), Jul. 13, 2012 , pp. 815-822.

Van Der Weijden, G.A. et al., "Relationship between the plaque removal efficacy of a manual toothbrush and brushing force", Journal of Clinical Periodontology Sep. 1, 1997 , pp. 413-416.

"International Application Serial No. PCT/US2013/050795, Search Report and Written Opinion mailed Dec. 12, 2013", 9 pages.

Lussi, Adrian et al., "Dental Erosion: From Diagnosis to Therapy", Monographs is Oral Science, vol. 20. 2006, University of Bern, School of Dental Medicine, 2006 , pp. 1-233. (2 Attachments: A. pp. 1-115: B. pp. 116-233).

* cited by examiner

FORCE SENSITIVE TOOTHBRUSH

RELATED APPLICATIONS

This application claims the benefit of U.S. App. No. 61/674,813 filed on Jul. 23, 2012, the entire content of which is hereby incorporated by reference.

BACKGROUND

Excessive force applied to teeth and with a toothbrush during brushing may cause tooth erosion, receding gums, and other dental problems. There have been attempts to mitigate this effect with a force-sensitive toothbrush that can alert a user when excessive force is applied. However, the prior art solutions to this problem require multiple components and often result in bulky, unattractive, and more expensive toothbrushes. As such, there are no commercially available force-sensitive toothbrushes even though the problems resulting from excessive brushing force are generally known.

There remains a need for a cost effective and ergonomic force-sensitive toothbrush.

SUMMARY

A force-sensitive toothbrush incorporates a bistable mechanism into the toothbrush handle. The mechanism can alert a user to excessive brushing force by changing shape in response to brushing forces exceeding a predetermined threshold. The mechanism can also automatically return to its original state when the brushing forces are lowered back down below the predetermined level. In one aspect, the mechanism may include a force-sensitive region having a principal beam and a secondary notched hinge buckling support beam located within the handle between the bristles and the gripping portion of the toothbrush. In another aspect, the force-sensitive region includes a principal beam and a secondary un-notched buckling support beam. In another aspect, the force-sensitive region includes a principal beam and a secondary support beam with a toothed clutch. These mechanisms can advantageously be molded into an integral toothbrush body using an injection molding operation.

BRIEF DESCRIPTION OF THE FIGURES

The invention and the following detailed description of certain embodiments thereof may be understood by reference to the following figures, in which like element numbers refer to like elements.

DETAILED DESCRIPTION

All documents mentioned herein are hereby incorporated in their entirety by reference. References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus the term "or" should generally be understood to mean "and/or" and so forth.

While the following description provides detailed embodiments for a force-sensitive toothbrush, it will be appreciated that the techniques disclosed herein may be suitably adapted to a variety of other personal care devices such as brushes, eyelash brushes, eyeliner applicators, oral irrigators, electric toothbrushes, and other oral care and personal care items.

Figure 1A:
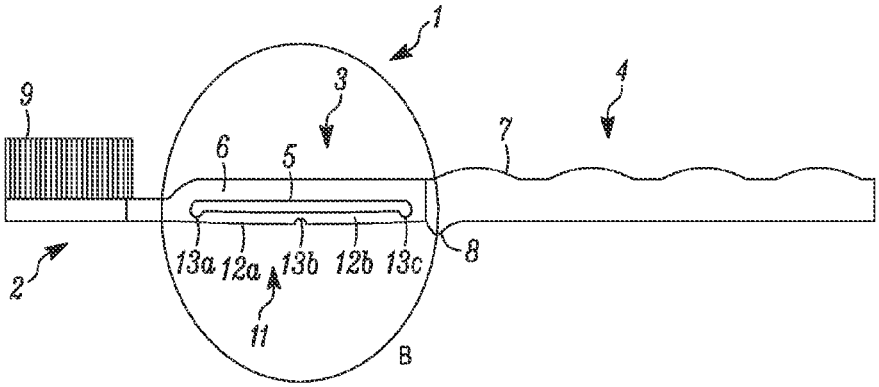
FIG. 1A is a side view of a force-sensitive toothbrush.

FIG. 1A is a side view of a force-sensitive toothbrush. The toothbrush 1 may include a head 2 and a force-sensitive region 3 that couples the head 2 to a handle region 4. A handle 7 in the handle region 4 may include any suitable ergonomic, gripping features such as indents for fingers, soft grippable material, and the like, along with a thumb grip 8. In use, a user grips the handle 7 and applies a force and moment to move the toothbrush about and balance a force of a number of bristles 9 on the head 2 against the user's teeth. A force is transmitted from the user's hand through the toothbrush 1 (including the force-sensitive region 3 that couples the handle 7 to the head 2) to the teeth thereby closing a structural loop between the user's hand and mouth through the toothbrush 1 on one hand and the user's body on the other. If a force applied by the user to the bristles 9 is below a predetermined threshold, the force-sensitive region 3 acts like a dual-beam structure cantilever comprised of a principal beam 6 in tension and a secondary beam 11 in compression. Modest deflection of the beams may occur as is the case with any toothbrush.

In general, the principal beam 6 and the secondary beam 11 of the force-sensitive region 3 may form a bistable mechanism that changes from a first state to a second state in response to an applied force on the bristles 9 that exceeds a predetermined force, and then returns to the first state when the applied force is released. In the second state, the secondary beam 11 may have a shorter end-to-end length (i.e., straight-line length between two endpoints of the beam). In other embodiments—e.g., where the toothed clutch of FIG. 3 is swapped in position with the principal beam—the secondary beam 11 may have a greater end-to-end length in the second state. More generally, the secondary beam 11 may transition in a bistable manner between a first state and a second state having different end-to-end lengths. This change in length relative to the principal beam 6 changes the structural characteristics of the overall dual-beam structure in a bistable manner as discussed below.

The secondary beam 11 may be displaced apart from and substantially parallel to the principal beam 6 as shown. In order to facilitate a bistable operation, the principal beam 6 may be relatively resilient, and the secondary beam 11 may collapse or otherwise compress or yield in a predetermined manner under a predetermined load. The secondary beam 11 may for example buckle, bend, or otherwise accommodate a bistable change in end-to-end length relative to the principal beam 6. This axial displacement of the secondary beam 11 provides a bistable mechanism of the force-sensitive region 1 when the secondary beam 11 bends, collapses, or otherwise response to a predetermined load on the bristles 9 of the toothbrush. A suitable bistable mechanism may be achieved in a variety of ways, with several specific embodiments described below by way of illustrative examples. The structure may advantageously be formed of as a single piece with integrally molded structural elements, thus avoiding the costs, reliability issues, and potential hazards associated with a multi-part assembly.

It will be understood that the predetermined load at which brushing is excessive may be subject to disagreement among dental professionals. The precise predetermined load at which bistable deflection occurs is thus not essential to this disclosure, except to note that the force-sensitive region 3 may be readily designed to yield under any particular predetermined load within the typical loads of ordinary brushing activity, which may be on the order of about two Newtons of normal brushing force. More generally, normal forces on the order of 0.5 to 2.5 Newtons may be observed during brushing, and the force-sensitive region 3 may be designed to yield at a predetermined load (such as 2.0 Newtons) within this range through suitable selections of material and dimensions for the principal beam and secondary beam. In some cases, and in particular for veterinary use, higher loads might be desired, and the mechanisms shown herein can be designed for higher forces also. Sizing of members to achieve desired state changes at predetermined loads can be performed by one skilled in the art of structural mechanics using energy methods, for example, and/or may be quantitatively determined and fine tuned with the use of finite element analysis software with buckling analysis capability such as ALGOR or ANSYS.

In one aspect, the secondary beam may buckle. The secondary beam 11 may curve slightly away from the principal beam 6 in overall shape, as shown by some representative dimensions in FIG. 1B; however, it will be noted that a line connecting the centers of hinges 13*a*, 13*b*, and 13*c* has a slight inflection inward toward the principal beam 6. In this configuration, as the force on the bristles 9 is increased, the compression force in a first element 12*a* and a second element 12*b* of the secondary beam 11 correspondingly increases. Hinges 13*a*, 13*b*, and 13*c*, which may be elastic notched hinge elements or any other similar hinging mechanisms, may be formed such that straight lines connecting the centroids of their thinned regions point inward toward a center of the force-sensitive region 3, even though the secondary beam 11 is overall concave and curved away from the principal beam. The hinges 13*a*, 13*b*, and 13*c* may, for example, be integral flexure hinges positioned at the ends and middle of the secondary beam 11. Such hinges may be formed for example by partial cylindrical cuts with the end hinges 13*a*, 13*c* facing towards the principal beam 6 and a center hinge 13*b* facing away from the principal beam 6. These are commonly referred to as "hourglass hinges."

Under sufficient load, the bending moment and axial force overcome the elastic resilience of the secondary beam 11 and the secondary beam 11 buckles upward (per the relative orientation of the centroids of the thinned regions, which provides an initial location of the central hinge 13*b* closer to the principal beam 6 than the end hinges 13*a*, 13*c*) such that the central hinge 13*b* moves inward until it contacts a side 5 of the principal beam 6. This motion may occur quickly, as typical of buckling, with the resultant impact readily heard and felt by a user even though the range of motion might only be on the order of about one to two millimeters for the design shown, or less than one to five millimeters for typically-dimensioned toothbrushes. Thus, the force-sensitive region 3 may provide feedback to a user when excessive brushing force is applied (e.g., the predetermined load is exceeded) in the form of an audible click, a tactile click, and/or a change in angle of the force-sensitive region 3 relative to the handle 7 and the head 2, with the feedback generated when the secondary beam suddenly changes shape and creates an impact with the principal beam 6.

When the secondary beam 11 thus makes contact with the upper beam 6 it can buckle no further and together the principal beam 6 and the secondary beam 11 act as a single, resilient member that can transmit additional force without damaging the toothbrush. When the excessive brushing force is relaxed, the principal beam 6 can straighten and the secondary beam 11 can snap back to an unbuckled position, thus restoring the force-sensitive region to a first state.

Figure 1B:
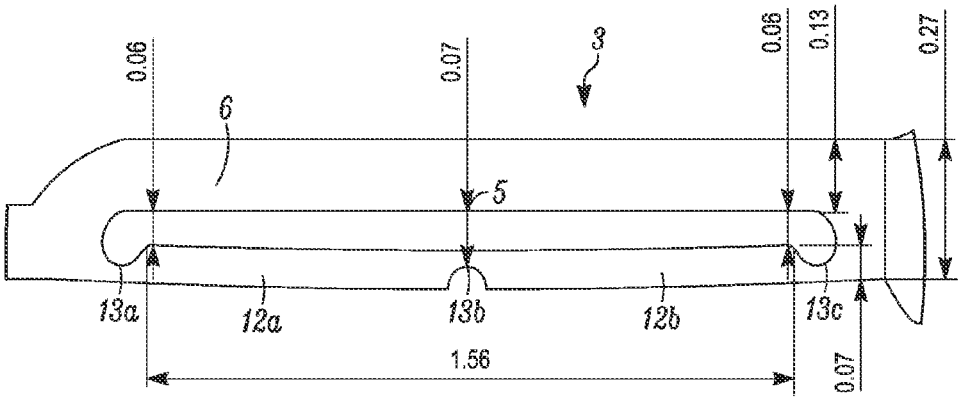
FIG. 1B is a close up side view of the force-sensitive region of the toothbrush of FIG. 1A.

The principal beam 6 may be about twice the thickness of the secondary beam 11. In one aspect, the principal beam 6 may be fabricated of a material and at a thickness such that it will not buckle or deform beyond the elastic zone under typical brushing forces (including even excessive brushing forces that the toothbrush 1 is intended to mitigate). Illustrative dimensions are shown in FIG. 1B. The principal beam 6 and the secondary beam 11 may be relatively wide with respect to their thickness such that operation of the force-sensitive region 3 is not significantly affected by lateral or torsional brushing forces during use. It will also be observed from the design of the force-sensitive toothbrush 1 that a body of the toothbrush 1 generally, and the force-sensitive region 3 in particular, may be fabricated as a single, integral workpiece using, e.g., injection molding or any other suitable mass production or rapid prototyping technique with a variety of polymers (e.g., thermoplastics, elastomers, thermosets, etc.) and/or other materials.

Figure 1C:
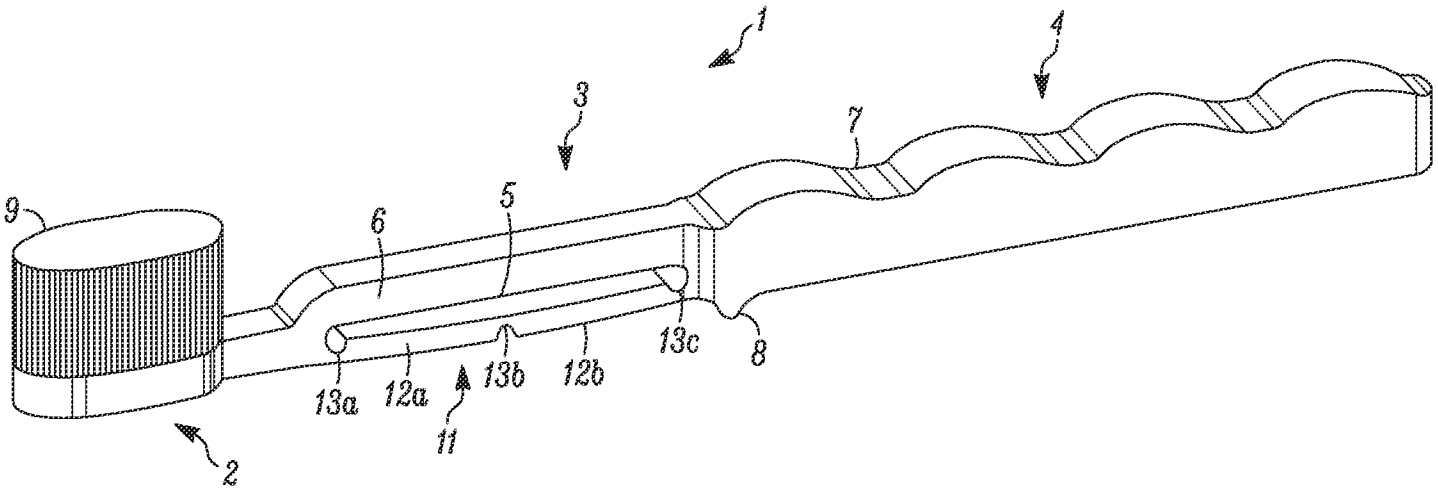
FIG. 1C is an isometric view of the toothbrush of FIG. 1A.

FIG. 1B is a close up side view of the force-sensitive region 3 of the toothbrush of FIG. 1A. FIG. 1C is an isometric view of the toothbrush of FIG. 1A.

Figure 2A:
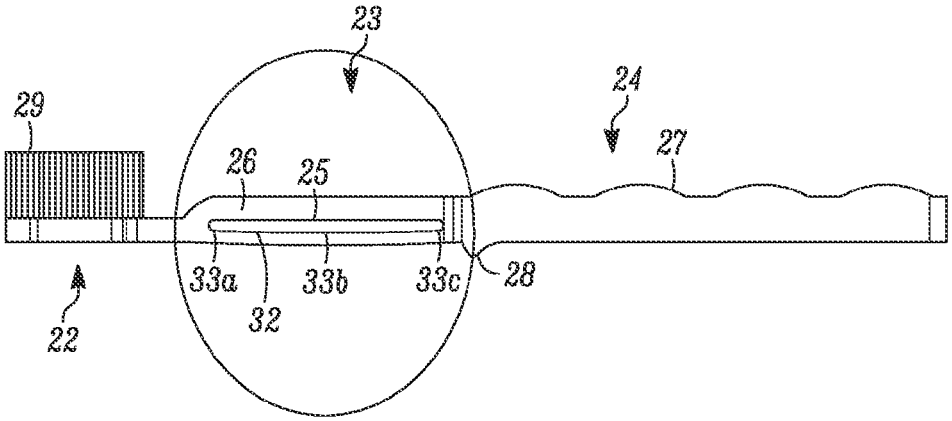
FIG. 2A is a side view of a force-sensitive toothbrush.

FIG. 2A shows a force-sensitive toothbrush. The toothbrush may include a head region 22 having bristles 29, a handle region 24 having a handle 27 and a thumb grip 28 for gripping by a user, and a force sensitive region 23. The force sensitive region 23 may include a principal beam 26 having a side 25 and a secondary beam 32 having a first end 33*a*, a center region 33*b*, and a second end 33*c*.

Similarly to the embodiment described above, as an applied force on the bristles 29 increases, a compression force in the secondary beam 32 also increases. Some bending moment is transmitted to first end 33*a* and the second end 33*c* of the secondary beam 32 as the principal beam 26 deflects downward. The bending moment imparts a slope to the structure at the end region 33*a* of the secondary beam 32. Under a predetermined force (e.g., an excessive brushing force), the bending moment and axial force on the secondary beam 32 overcome the elastic resilience of the secondary beam 32 and the secondary beam 32 bends and buckles upward such that the central region 33*b* contacts the side 25 of the principal beam 26. This motion may occur quickly, with the resultant impact readily heard and felt by a user even though the range of motion is typically only on the order of about one to two millimeters for the design shown, or less than one to five millimeters for typically-dimensioned toothbrushes. In this manner, the force-sensitive region 23 may provide audible, tactile, and structural feedback as described above.

When the secondary beam 32 thus makes contact with the principal beam 26, it can bend no further and together the principal beam 26 and the secondary beam 32 act as a single, resilient member that can transmit a force beyond the excessive brushing force without damaging the toothbrush. When the brushing force is relaxed, the principal beam 26 can straighten and the secondary beam 32 can elastically return to an unbuckled shape, thus restoring the force-sensitive region to a first state.

The principal beam 26 may be about twice the thickness of the secondary beam 32. In one aspect, the principal beam 26 may be fabricated of a material and at a thickness such that it will not buckle or deform beyond the elastic zone under typical brushing forces (including even excessive brushing forces that the toothbrush 1 is intended to mitigate). The principal beam 26 and the secondary beam 32 may be relatively wide with respect to their thickness such that operation of the force-sensitive region 23 is not significantly affected by lateral or torsional brushing forces during use.

Figure 2B:
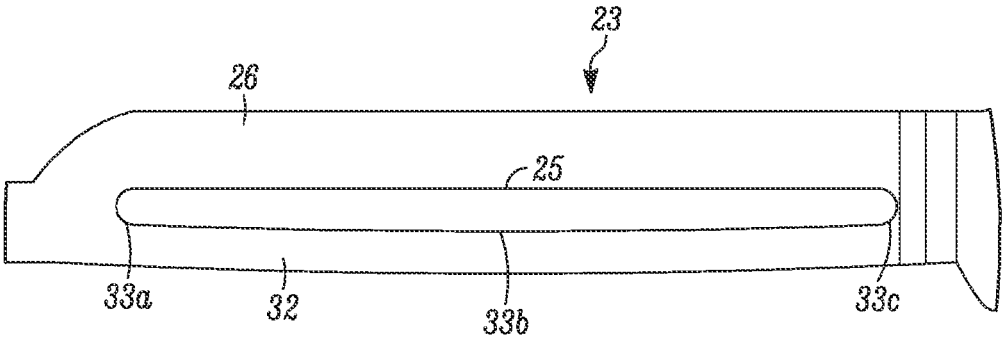
FIG. 2B is a close up side view of the force-sensitive region of the toothbrush of FIG. 2A.
Figure 2C:
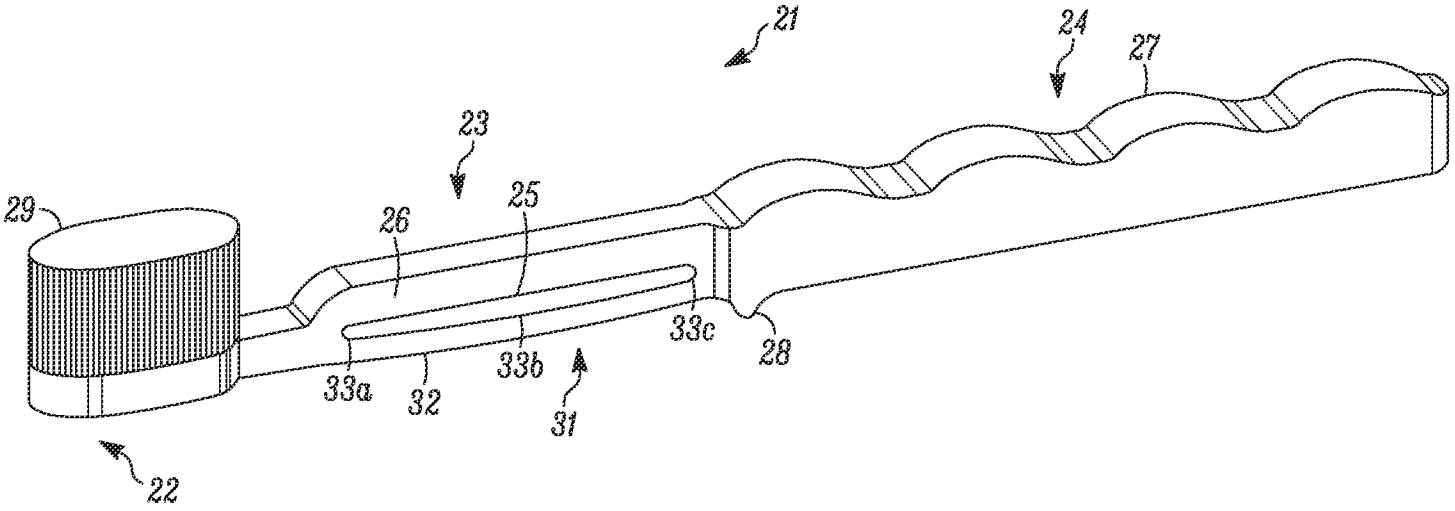
FIG. 2C is an isometric view of the toothbrush of FIG. 2A.

FIG. 2B is a close up side view of the force-sensitive region of the toothbrush of FIG. 2A. FIG. 2C is an isometric view of the toothbrush of FIG. 2A.

Figure 3A:
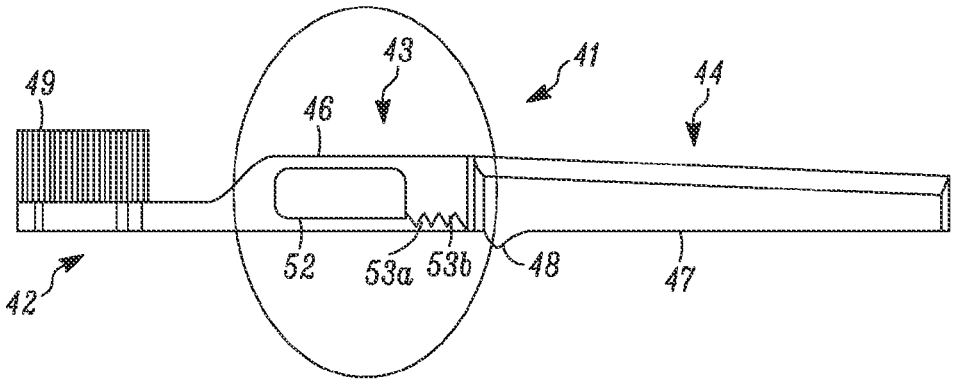
FIG. 3A is a side view of a force-sensitive toothbrush.
Figure 3B:
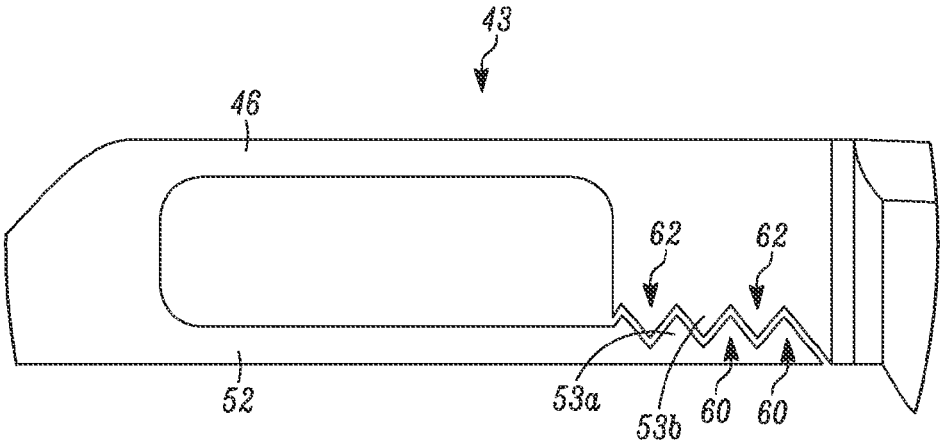
FIG. 3B is a close up side view of the force-sensitive region of the toothbrush of FIG. 3A.
Figure 3C:
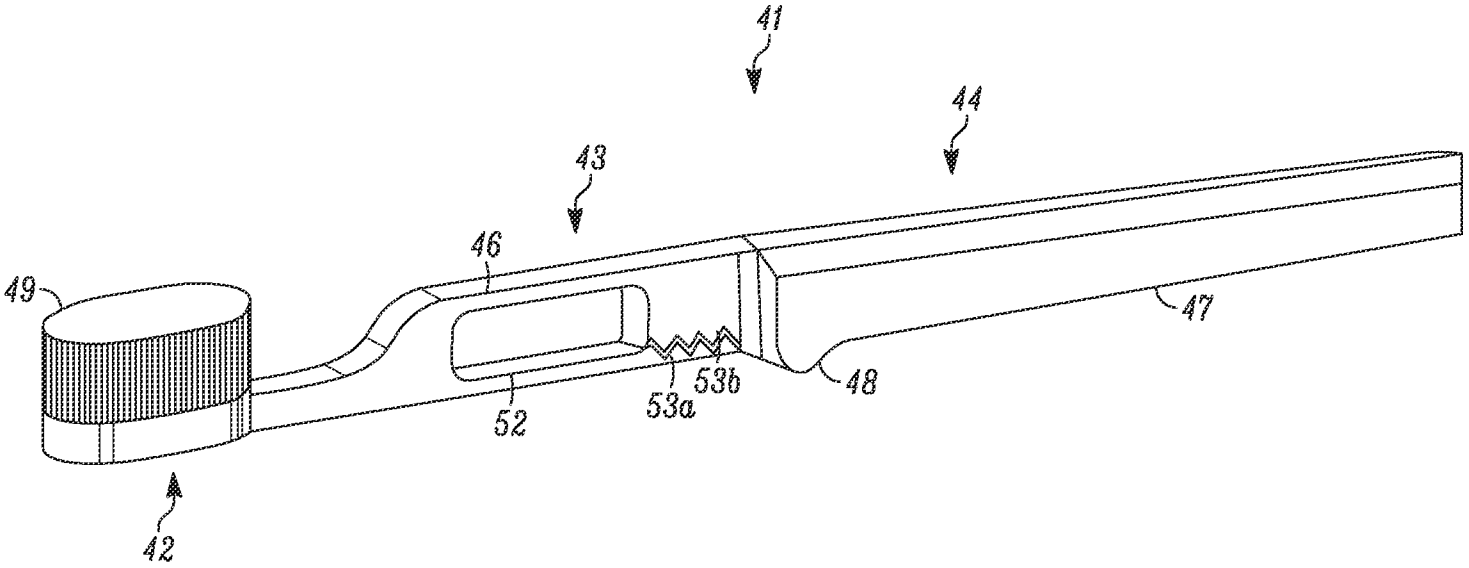
FIG. 3C is an isometric view of the toothbrush of FIG. 3A.

FIG. 3A shows a force-sensitive toothbrush. The toothbrush 41 may include a head region 42 having bristles 49, a handle region 44 having a handle 47 and a thumb grip 48 for gripping by a user, and a force-sensitive region 43. The force sensitive region 43 may include a principal beam 46 and a secondary beam 52 with a mechanical slip clutch formed of a first toothed region 53*a* and a second toothed region 53*b*. While the depicted toothed clutch performs adequately, other engagement means and configurations will be apparent to those skilled in the art of clutch design, and may be suitably adapted for use in the force-sensitive region 43 contemplated herein.

The secondary beam 52 may be a straight beam, or the secondary beam 52 may be curved as desired for ergonomic or other reasons. At an end of the secondary beam 52 nearest to the handle 27, the secondary beam 52 may have a number of teeth 60 in a saw tooth or similar configuration. It will be appreciated that this placement of the teeth 60 is not critical, and the teeth 60 may instead be placed at an opposing end nearest to the head region 42, or in the middle, with two extending arms from each end. The angle and length of each tooth 60 may vary according to a degree of axial force the beam is to withstand before release. These teeth 60 may engage complementary teeth 62 that are rigidly coupled to the principal beam 46, handle 47, or other suitable location. Injection molding or similar fabrication techniques permit very close placement of the teeth 60 and complementary teeth 62 to within a fraction of a millimeter.

As the force on the bristles 49 is increased, the principal beam 46 may bend, and the compression force in the secondary beam 52 may increase. Thus, as the brushing force increases, the resulting compression in the secondary beam 52 may cause the teeth 60 to slip on the complementary teeth 62 to provide a tactile click and a physical displacement of the head region 42 of the toothbrush. When the brushing force is released, the principal beam 46 may elastically return to an unbent shape, and the teeth 60, 62 may return to their initial positions. The action of the teeth slipping over each other creates a tactile sensation that the user may feel in addition to the feeling of suddenly greater compliance in the toothbrush handle. The sensation of suddenly greater compliance may also be achieved with the other bistable techniques described herein.

The principal beam 46 may be about two to three millimeters thick and the secondary beam 52 may be about one to two millimeters thick. More generally, the principal beam 52 may be any suitable thickness to permit normal brushing forces, and to resiliently bend in response to excessive brushing forces. The secondary beam 52 may be sufficiently thick to maintain the teeth 60 on the secondary beam 52 in frictional engagement with the complementary teeth 62 on the principal beam 46.

It will be understood that the teeth 60, 62 may include any number of teeth having any suitable angle to provide slip clutching as contemplated above. In addition, the teeth 60, 62 may be asymmetrical, with a leading edge (that resists bending) having a first angle for release when excessive brushing force is applied, and a trailing edge (that resists return of the principal beam 46 to a first shape) having a second angle to permit elastic forces in the principal beam 46 to return to a straight shape notwithstanding the gripping forces of the trailing edges. These angles may be adapted to provide greater resistance to a transition from the first state to the second state than to a transition from the second state to the first state (e.g., returning to a state for normal use).

While the teeth 62 are illustrated in the plane of the drawing, it will be understood that the teeth 62 may be molded into any suitable angle relative to the axis of the toothbrush. For example, by orienting the teeth 62 orthogonally to the plane of the drawing, in-mouth forces from teeth, lips, and so-forth on the secondary beam 52 may be reduced in order to prevent interference with the load required to transition between states.

Figure 4:
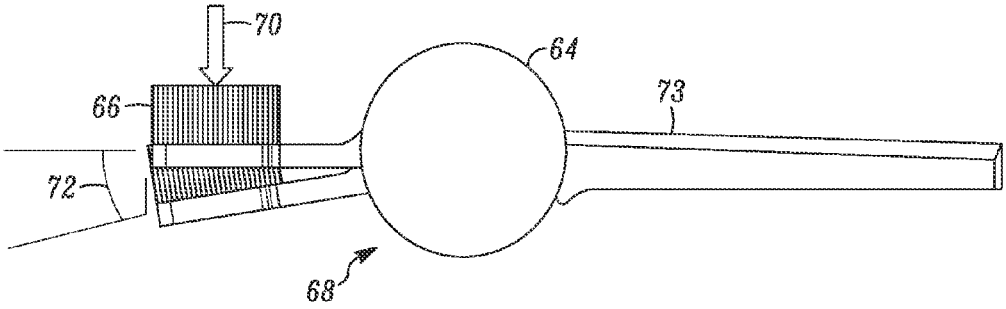
FIG. 4 depicts an angle change in a force-sensitive toothbrush.

FIG. 4 depicts angle change in a force-sensitive toothbrush as contemplated herein. As noted above, a force-sensitive region 64 may include a bistable, dual-beam structure having a first state in which a head 66 of a toothbrush 68 is in an ordinary orientation for use. With an application of sufficient normal force 70 to the head 66—e.g., an excessive brushing force—the force-sensitive region 64 may change to a second state, such as using any of the techniques described above, in which the head 66 deflects by an angle 72 (relative to a handle 73) to indicate to a user that excessive force has been applied. When the normal force 70 is reduced or removed, the force-sensitive region 64 may resiliently return to the first state with the head 66 once again oriented for use in brushing teeth.

During the transition from the first state to the second state, the force-sensitive region 64 may also provide tactile or audio feedback such as a clicking noise or feel using, e.g., the various bistable mechanisms described above. To accentuate the tactile or audible feedback, a sharp bump or other protrusion (not shown) can be included at the center of the secondary beam or the principal beam to create a higher-contact-pressure region along the corresponding surfaces when they touch.

Figure 5:
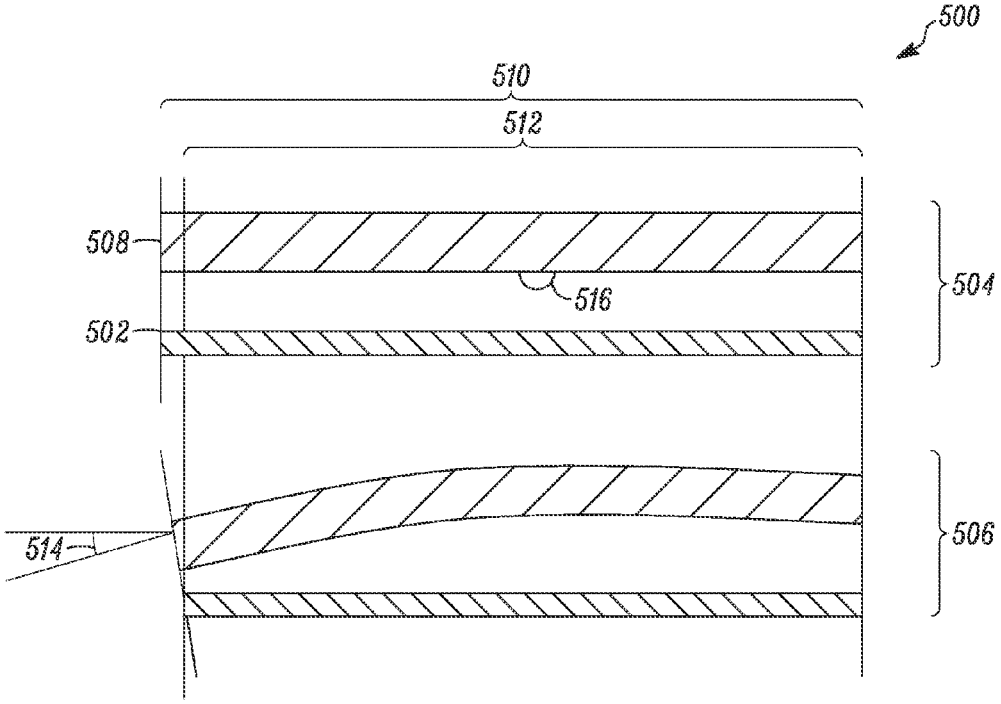
FIG. 5 shows a generalized, bistable, dual beam structure.

FIG. 5 shows a generalized, bistable, dual beam structure. The structure 500 is shown with a secondary beam 502 in a first state 504 and a second state 506.

One way to view the bistable operation described in the embodiments above is as a sudden change in length of a secondary beam 502 relative to a principal beam 508 under a predetermined load. That is, whether slip clutching against the principal beam 508, (reversibly) buckling against the principal beam 508, or bending against the principal beam 508, the secondary beam 502 shortens slightly and reversibly in end-to-end length under a compressive force that is created when the principal beam 508 yields to a brushing load. While the principal beam may also change somewhat in end-to-end length as it bends, the secondary beam 502 will generally change more in length, that is, change in length relative to the principal beam 508, during a bistable transition. By changing from a first length 510 (corresponding to the first state described above) to a second length 512 (corresponding to a second state) slightly shorter than the first length 510 as generally depicted, the secondary beam 502 accommodates further bending of the principal beam 508, accompanied by a change in an angle 514 of the force-sensitive region coupling the handle to the head. As noted above, this affect may be similarly achieved in certain embodiments where the beams are reversed and the second length 512 is slightly longer than the first length 510. The change in angle 514 can be perceived by a user along with audible or tactile feedback created by the state change in the secondary beam 502 so that the user is aware that a load threshold for brushing force has been exceeded.

In some embodiments described above, a bistable transition may be achieved with a buckling of the secondary beam 502. In general buckling should be understood to mean a sudden change in geometry of a structural member subjected to high compressive stress, typically with an eccentricity that introduces a moment to the buckling member. Usually this is accompanied by a rapid movement and change in shape. While more detailed and formal definitions exist, this contemplates an adequately wide range of deformations to accurately describe many of the embodiments described above. The term "buckling" as used herein is intended to include any such deformation. In particular, the bistable mechanism of the force-sensitive region may employ a controlled buckling, in which an anticipated buckling of the secondary beam is constrained by the rigid surface of an adjacent principal beam. Herein, the buckling is also preferably elastic, which means that when the load is released, the structure returns to its original shape.

In one aspect, a protrusion 516 may be included on the principal beam 504 or the secondary beam 502 that provides a high-impact stress point when the secondary beam 502 buckles into the primary beam 508. This may generally enhance tactile or auditory feedback from the click that occurs upon the high-speed impact following the sudden movement of the secondary beam 502 as it buckles into the primary beam 508. In general, the protrusion 516 may be positioned at or near the center of the beams 502, 508 for maximum effect, although enhancement of tactile feedback may be obtained over a wide range of possible positions.

As used herein, a "sudden" movement is intended to refer to the rapid movement typical of buckling deformation, which in the context of the toothbrushes contemplated herein also corresponds to a movement of sufficient speed to provide auditory or tactile feedback upon contact of the "suddenly" moving part (e.g., a buckling or tooth-clutched beam) against a relatively fixed contact point. Thus "sudden" may in one aspect be understood to mean with sufficient acceleration to reach a velocity that provides auditory or tactile feedback within a predetermined range of motion, such as from a first state to a second state of the bistable elements contemplated herein. In the context of the entire device, "sudden" may also mean reaching a velocity that provides sufficient auditory or tactile feedback to alert a toothbrush user to reduce brushing force.

It will be noted that FIG. 5 abstracts away mechanical details of the secondary beam 502. This figure is intentionally general in nature, and is not intended to illustrate specific dimensions, displacements, or bending patterns in either the principal beam 504 or the secondary beam 502. The general nature of this figure is instead intended to suggest that a variety of other bistable mechanisms might also or instead be used in the force-sensitive region of a toothbrush, any of which may be equally suitable for fabrication as an integral, one-piece component using, e.g., injection molding or the like. Accordingly, while particular embodiments of the present invention have been shown and described, it will be apparent to those skilled in the art that various changes and modifications in form and details may be made therein without departing from the spirit and scope of this disclosure and are intended to form a part of the invention as defined by the following claims, which are to be interpreted in the broadest sense allowable by law.

What is claimed is:

1. A toothbrush comprising:

a handle;

a head with bristles; and a force sensitive region coupling the head to the handle, the force sensitive region including a principal beam and a secondary beam arranged in a bistable configuration to transmit normal loads from the head to the handle, wherein the principal beam elastically bends in response to a brushing force on the head thereby creating an axial force in the secondary beam, and wherein the secondary beam responds to the axial force by changing from a first state to a second state having a different end-to-end length when the brushing force on the head exceeds a predetermined amount, and further wherein the secondary beam includes a slip clutch that moves from the first state to the second state in response to the predetermined amount, and the slip clutch includes a first number of teeth on the secondary beam and a second number of teeth on the principal beam, wherein at least one of the first number of teeth is engaged with at least one of the second number of teeth.

2. The toothbrush of claim 1 wherein the secondary beam returns to the first state when the force on the head falls below a second predetermined amount less than the predetermined amount.

3. The toothbrush of claim 1 wherein the predetermined amount is between 0.5 and 2.5 Newtons.

4. The toothbrush of claim 1 wherein the predetermined amount is greater than 0.5 Newtons.

5. The toothbrush of claim 1 wherein the force-sensitive region provides feedback to a user when the secondary beam transitions between the first state and the second state.

6. The toothbrush of claim 5 wherein the feedback includes a change in angle of the force-sensitive region.

7. The toothbrush of claim 5 wherein the feedback includes an audible click.

8. The toothbrush of claim 5 wherein the feedback includes a tactile click.

9. The toothbrush of claim 1 wherein the secondary beam is displaced apart and substantially parallel to the principal beam in the first state.

10. The toothbrush of claim 1 wherein the teeth are angled to provide a greater resistance when moving from the first state to the second state than when moving from the second state to the first state.

11. The toothbrush of claim 1 wherein the secondary beam is configured to withstand a degree of axial force before releasing to the different end-to-end length of the second state.

12. The toothbrush of claim 11 wherein an angle and a length of each of the of the first number of teeth and the second number of teeth is selected according to the degree of axial force that the secondary beam withstands before releasing to the different end-to-end length.

13. The toothbrush of claim 12 wherein the first number of teeth and the second number of teeth are asymmetrical, with a leading edge that resists compression of the secondary beam and bending of the principal beam when a brushing force is applied, and a trailing edge having a second angle to permit elastic forces in the principal beam to return to a straight shape.

14. The toothbrush of claim 13 wherein the leading edge and the trailing edge are shaped to provide a greater resistance to a first transition from the first state to the second state than a second transition from the second state to the first state.

15. A toothbrush comprising:

a handle;

a head with bristles; and a force sensitive region coupling the head to the handle, the force sensitive region including a principal beam and a secondary beam arranged in a bistable configuration to transmit normal loads from the head to the handle, wherein the principal beam elastically bends in response to a brushing force on the head thereby creating an axial force in the secondary beam, and wherein the secondary beam responds to the axial force by changing from a first state to a second state having a different end-to-end length when the brushing force on the head exceeds a predetermined amount, and further wherein the secondary beam includes a slip clutch that moves from the first state to the second state in response to the predetermined amount, and the slip clutch includes a first number of teeth on the secondary beam and a second number of teeth on the handle, wherein at least one of the first number of teeth is engaged with at least one of the second number of teeth.

16. A toothbrush comprising:

a handle;

a head with bristles; and a force sensitive region coupling the head to the handle, the force sensitive region including a principal beam and a secondary beam arranged in a bistable configuration to transmit normal loads from the head to the handle, wherein the principal beam elastically bends in response to a brushing force on the head thereby creating an axial force in the secondary beam, and wherein the secondary beam responds to the axial force by changing from a first state to a second state having a different end-to-end length when the brushing force on the head exceeds a predetermined amount, and further wherein the secondary beam includes a slip clutch that moves from the first state to the second state in response to the predetermined amount, and the slip clutch includes a first number of teeth on the secondary beam and a second number of teeth disposed near an interface of the principal beam and the handle, wherein at least one of the first number of teeth is engaged with at least one of the second number of teeth.

* * * * *